US009836975B2

(12) United States Patent
Herron

(10) Patent No.: US 9,836,975 B2
(45) Date of Patent: Dec. 5, 2017

(54) SYSTEM AND METHOD FOR IMPLEMENTING AN EXCEPTION TO A PARKING RESTRICTION

(75) Inventor: Neil Andrew Herron, Tyne & Wear (GB)

(73) Assignee: Grid Smarter Cities Limited, Tyne & Wear (GB)

( * ) Notice: Subject to any disclaimer, the term of this patent is extended or adjusted under 35 U.S.C. 154(b) by 274 days.

(21) Appl. No.: 13/883,477

(22) PCT Filed: Nov. 5, 2010

(86) PCT No.: PCT/GB2010/051853

§ 371 (c)(1),
(2), (4) Date: Jun. 20, 2013

(87) PCT Pub. No.: WO2012/059705

PCT Pub. Date: May 10, 2012

(65) Prior Publication Data

US 2013/0261958 A1 Oct. 3, 2013

(51) Int. Cl.

| | |
|---|---|
| ***G08G 1/14*** | (2006.01) |
| ***G07B 15/02*** | (2011.01) |
| ***G07F 17/24*** | (2006.01) |

(52) U.S. Cl.

CPC ..... *G08G 1/143* (2013.01); *G07B 15/02* (2013.01); *G07F 17/24* (2013.01)

(58) Field of Classification Search

CPC ..... G06Q 30/0284; G06Q 20/206; B60R 2325/101; B60R 2325/105

USPC ..... 701/532

See application file for complete search history.

(56) References Cited

U.S. PATENT DOCUMENTS

| | | | | |
|---|---|---|---|---|
| 7,104,447 | B1 * | 9/2006 | Lopez | G07B 15/02 235/381 |
| 2005/0083212 | A1 * | 4/2005 | Chew | G08G 1/14 340/932.2 |
| 2006/0220911 | A1 * | 10/2006 | Jaupitre | G08G 1/14 340/932.2 |
| 2006/0255119 | A1 * | 11/2006 | Marchasin | B60R 25/093 235/375 |
| 2007/0016539 | A1 | 1/2007 | Groft et al. | |
| 2007/0029825 | A1 * | 2/2007 | Franklin | B60R 9/10 293/128 |

(Continued)

FOREIGN PATENT DOCUMENTS

| | | |
|---|---|---|
| GB | 2 407 192 A | 4/2005 |
| WO | 2009/054014 A1 | 4/2009 |

OTHER PUBLICATIONS

International Search Report issued in PCT/GB2010/051853, dated Mar. 3, 2011 (3 pages).

(Continued)

*Primary Examiner* — Redhwan K Mawari
(74) *Attorney, Agent, or Firm* — Osha Liang LLP

(57) ABSTRACT

An apparatus and method for implementing an exception to a parking restriction, the exception being a parking area defined by one or more coordinates, includes monitoring an area including the parking area; detecting a vehicle in the monitored area; determining whether the detected vehicle is positioned within the parking area; and determining whether the vehicle has permission to park in the parking area. The parking area is not marked on the road.

22 Claims, 3 Drawing Sheets

(56) References Cited

U.S. PATENT DOCUMENTS

| | | | | |
|---|---|---|---|---|
| 2007/0146166 | A1* | 6/2007 | Sato | B62D 15/028 340/932.2 |
| 2008/0101656 | A1* | 5/2008 | Barnes | G08G 1/017 382/104 |
| 2009/0265099 | A1* | 10/2009 | Gottlieb | G01C 21/3697 701/532 |

OTHER PUBLICATIONS

Written Opinion issued in PCT/GB2010/051853, dated Mar. 3, 2011 (8 pages).

* cited by examiner

SYSTEM AND METHOD FOR IMPLEMENTING AN EXCEPTION TO A PARKING RESTRICTION

This invention relates to methods and systems for implementing, indicating and enforcing an exception to a parking restriction. In particular, but not exclusively, this invention relates to methods and systems for implementing, indicating and enforcing loading bays in areas in which a parking restriction exists.

Kerb space is at a premium in many major cities, with competing demands from commercial vehicles wishing to service and/or load and unload goods to shops, offices, restaurants and other businesses at all times of day and night.

However, there is also a requirement to keep traffic moving and reduce congestion. Therefore, parking, waiting and/or stopping is restricted on many roads. Parking restrictions are enforced by parking enforcement personnel such as Civil Enforcement Officers or by CCTV operators, who issue fines or Penalty Charge Notices (PCNs) to vehicles parked in contravention of the rules. While it is necessary to rigorously enforce parking and loading restrictions, this may penalise operators who need to stop or park as close as possible to businesses for delivery or servicing.

In order to enable loading and unloading of goods, designated loading bays or areas at which loading is permitted are provided in areas where parking or stopping is otherwise restricted. Designated loading bays are generally indicated by boxes marked on the road. Sections of the highway where loading and unloading is prohibited are indicated by markings on the highway and the kerb, and accompanied by upright signs. Signs may be used to indicate the times at which stopping and/or loading and unloading are permitted or prohibited.

A problem is that, due to an insufficient number of such loading bays in busy areas, commercial vehicles receive a disproportionate number of penalty charge notices or parking fines. For example, a parking restriction may apply on a street containing a number of businesses, each requiring deliveries, but with only a single loading bay provided. Once the loading bay is full, other vehicles making a delivery must either park in contravention of the parking restriction, or abort the delivery.

It has been proposed to book or reserve time slots at loading bays. However, this scheme fails when a 'rogue' vehicle parks in the loading bay at the booked time, resulting in the operator who booked the time slot failing to make the delivery, or incurring a PCN for parking elsewhere in a restricted area.

Alternatively, loading bays protected by rising barriers may be created. However, this can be expensive as it involves structural alteration to the highway and street furniture, and is visually intrusive.

Creating more loading bays would simply lead to more vehicles creating similar problems. Furthermore, creation of new parking restrictions or loading bays involves lengthy consultation, legal work and implementation, and may not provide an optimum solution.

Yet another problem is that drivers often fail to read or correctly interpret road markings and signs relating to parking or stopping restrictions, and thereby obstruct traffic by parking in contravention of the restrictions, and unnecessarily receive a fine or PCN by not parking or stopping in the correct location.

The present invention seeks to overcome the above-mentioned problems.

According to an aspect of the invention, there is provided a method for implementing an exception to a parking restriction, the exception being a parking area defined by one or more coordinates, the method comprising the steps of:

receiving vehicle position information indicating the current position of a vehicle;

guiding the vehicle into the parking area by indicating the location of the parking area and the position of the vehicle on a display;

monitoring an area including the parking area;

detecting a vehicle in the monitored area;

determining whether the detected vehicle is positioned within said parking area; and determining whether said vehicle has permission to park in the parking area.

By guiding a vehicle into a permitted or exempted parking area by displaying the location of the parking area on a screen, and determining whether a vehicle detected at the location of an excepted parking area has permission to park in the parking area, it is possible to provide and enforce parking areas without necessarily making the parking areas visible to the ordinary motorist. An exempted parking area may be a section of a parking restriction in which loading and unloading is allowed at certain times. Alternatively, the parking area may be defined only by its coordinates, without being indicated on the road. The present invention provides a means for indicating these exempted parking areas to the driver of a vehicle, in addition to any signs and/or markings on the road or kerbside, thereby reducing the likelihood of the vehicle being parking in contravention of the parking restrictions and incurring a PCN or other penalty.

In one embodiment, the parking area is not marked on the road.

Advantageously, by not marking the parking area on the road, the ordinary motorist is deterred from parking in the parking area, thereby reserving the parking area for legitimate exempted users.

According to a second aspect of the invention, there is provided a method for implementing an exception to a parking restriction, the exception being a parking area defined by one or more coordinates, the method comprising the steps of:

monitoring an area including the parking area;

detecting a vehicle in the monitored area;

determining whether the detected vehicle is positioned within the parking area; and determining whether the vehicle has permission to park in the parking area;

wherein the parking area is not marked on the road.

By defining a parking area by one or more coordinates, rather than marking the parking area on the road, the parking restriction will look like a normal parking restriction (for example double red or double yellow lines), deterring ordinary motorists from parking and obstructing the road. However, by determining whether a vehicle detected at the location of an excepted parking area has permission to park in the parking area, when enforcing the parking restriction, a permitted user may use the loading bay without incurring a fine or PCN. The present invention therefore provides the advantages of reducing the number of fines or PCNs incurred by legitimate users of the exempted areas, and enabling businesses to be serviced at the same time as keeping traffic flowing. In addition, an advantage of the parking area not being marked on the road is that there is no cost or disruption to the highway arising from pavement modification, line painting, sign installation, and maintenance.

The method may further comprise the step of charging an operator or user of the vehicle for permission to park in the parking area.

In this way, the local authority or other entity, for example a commercial operator responsible for enforcement of the parking restriction, may benefit from a charge levied on users of the system. As examples, the charge may be implemented as a service charge for usage of one or more parking exceptions by one or more vehicles or users, or may be levied each time a vehicle makes use of a parking exception.

The method may further comprise the step of issuing a fine or penalty in respect of the vehicle if it is determined that the vehicle does not have permission to park in the parking area.

By verifying whether a vehicle has permission to park in the parking area prior to issuing a fine or PCN, the administrative burden on commercial operators, who would otherwise need to deal with the administration of every fine or PCN, is reduced.

A fine or penalty issued in respect of the vehicle may be annulled if the vehicle is determined to have permission to park in the parking area.

This feature provides the advantage that, even if it not determined whether a vehicle has permission to park in a parking bay or exempted area prior to issuance of a fine or PCN, for example if a PCN is issued by a Civil Enforcement Officer, the fine or PCN may be subsequently annulled.

The exception to the parking restriction may apply at a predetermined time or times and/or to predetermined vehicles and/or users, and/or to predetermined classes of users and/or vehicles.

The advantage of this feature is that the exemptions to the parking restriction can be created for special events, and can removed at times when traffic is heavy. For example, exempted parking areas could be provided on one side of the road in the morning when traffic flow is heavy on the opposite side, and vice versa when the reverse is true in the afternoon. Also, by providing parking areas for specific vehicles or specific users, it is possible to adapt the parking restrictions and exemptions to the needs of specific users and businesses. Exemptions to parking restrictions may also be created for specific classes of users or vehicles, such as disabled users (e.g. Blue Badge holders), electric vehicles, motorcycles and so on. This kind of flexibility is not possible in the prior art.

The step of monitoring the area may be performed using a camera.

The step of determining whether the detected vehicle is positioned within said parking area may include:

- displaying an image captured by the camera; and
- superposing a representation of the parking area over the displayed image.

The advantage of this feature is that, even though the parking area is not marked on the road, it will be overlaid onto camera images viewed by enforcement operators, so that an enforcement operator can easily determine whether a vehicle parked in the area of the parking restriction is positioned within the exempted parking area.

The step of determining whether the vehicle has permission to park in the parking area at the time of detecting said vehicle may include:

- determining an identification number of the vehicle from image data captured by the camera;
- checking the identification number against identification numbers stored in a permission table.

An advantage of this feature is that a vehicle can be identified either using a manual recognition system, or automatically using automated number plate recognition, and rapidly checked against known exemptions to determine whether the vehicle is permitted to park in the parking area. A CCTV operator can be alerted that a vehicle is exempted from the parking restriction prior to issuing a fine or PCN.

The step of determining whether the detected vehicle is positioned within the parking area and/or the step of determining whether the detected vehicle has permission to park in the parking area may include:

- receiving data transmitted by the vehicle and/or a device located proximal the vehicle.

The data may include at least one of the following:

- position information indicating the position of the vehicle and/or the device;
- parking area usage information including a time or times at which the vehicle is parked in the parking area and/or at which the vehicle enters and/or exits the parking area; and/or
- identification information identifying the vehicle.

An advantage of this feature is that the information transmitted by the vehicle or device can be used to check whether a vehicle detected in the monitored area is exempt from the parking restriction. Transmission of position information and/or parking area usage information ensures that stop times and positions are accurately recorded. In the case in which a parking attendant or Civil Enforcement Officer using a GPS-enabled hand-held computer detects a vehicle parked in a restricted parking area, he may use the device to transmit position and/or time and/or identification information to determine whether a parking exemption is in force at that location and/or time and/or for a given vehicle. The transmitted information may then be used to issue a parking fine or PCN.

The position information may be determined by a global navigation satellite system.

The data may include position information indicating the position of the vehicle, the method further including the steps of:

- correcting the position information based on a comparison between the received position information and a predefined road layout; and
- transmitting the corrected position information to the vehicle.

The advantage of this feature is that it enables the accuracy of the position information to be improved. Preferably, position information is received from the vehicle at regular intervals, allowing the vehicle to be tracked around the road network. Accurate knowledge of the positions of the roads allows correction of the position information.

The data may include data received by the vehicle from a kerbside transmitter.

Advantageously, data read from a kerbside transmitter may be used to verify the position of a vehicle. This may be useful for improving the accuracy of position information in built-up areas where multipath errors or 'canyoning' can affect GNSS performance.

The kerbside transmitter may be a radio-frequency transmitter.

Advantageously, a radio-frequency transmitter does not require a direct line of sight.

The kerbside transmitter may be a Wi-Fi™ or Bluetooth™ transmitter.

The kerbside transmitter may be a radio-frequency identification (RFID) tag.

Advantageously, a radio-frequency identification tag does not necessarily need its own power source, reducing the costs of installation and maintenance.

The method may further comprise the steps of:

receiving a request for permission to park a vehicle in said parking area;

checking whether the parking area is available; and entering identification information of said vehicle in a permission table if the parking area is available.

An advantage of this feature is that the parking area may be booked for a specific vehicle. Reserving a delivery slot enables the user to park close to the delivery location, thereby reducing kerb time.

The method may include transmitting location information indicating the location of the parking area.

By transmitting location information indicating the location of the parking area, it is not necessary for a vehicle to store all the locations of parking areas in advance. Further, this feature provides the advantage of allowing updated location information to be transmitted to users of the parking areas in real time.

The location information may include permission information indicating whether the vehicle has permission to use the parking area.

Advantageously, this enables a user to display only those parking areas where a specific vehicle has permission to stop.

The permission information may indicate a time or times at which the vehicle has permission to use the parking area.

The parking area may be pre-booked for the vehicle.

The advantage of this feature is that an exempted parking area may only be revealed to users having permission to use the parking area, reducing the likelihood of another vehicle stopping in the parking area.

According to a third aspect of the present invention, there is provided a method for indicating an exception to a parking restriction, the exception being a parking area defined by one or more coordinates, the method comprising the steps of:

receiving location information relating to the location of the parking area;

receiving vehicle position information indicating the current position of the vehicle; and indicating the location of the parking area and the vehicle position on a display;

wherein the parking area is not marked on the road.

By defusing a parking area by one or more coordinates, rather than marking the parking area on the road, and indicating the location of the parking area on a display, the parking areas are visible only to permitted users of the system. However, to the ordinary motorist, the parking restriction will look like a normal parking restriction (for example double red or double yellow lines), deterring the motorist from parking and obstructing the road. The present invention therefore provides the advantages of keeping the parking area free for legitimate users and enables businesses to be serviced while at the same time keeping traffic flowing. In addition, an advantage of the parking area not being marked on the road is that there is no cost or disruption to the highway arising from pavement modification, line painting, sign installation, and maintenance.

The method may further comprise the steps of:

transmitting the vehicle position information to a central system; and receiving corrected vehicle position information from the central system, based on a comparison between the transmitted vehicle position information and a road layout map; wherein the vehicle position is indicated on the display based on the corrected vehicle position information.

An advantage of this feature is that it enables the accuracy of the position information to be improved.

The method may further comprise the step of:

alerting a driver of the vehicle when the vehicle is positioned within the parking area.

Advantageously, this improves safety by ensuring that the driver parks in the correct spot on the road, without the driver having to concentrate on the display.

The method may further comprise the step of receiving a signal from a kerbside transmitter when the vehicle is within or proximal to the parking area.

Advantageously, this improves safety by ensuring that the driver parks in the correct location of the parking area, even where the parking area is not marked on the road. This is particularly advantageous in built-up areas where GPS position information may not be reliable, as it allows the location of the parking area to be identified more accurately, or may be used to guide the vehicle to the correct location.

The method may further comprise the step of determining whether the vehicle is positioned within the parking area, based on the signal received from the kerbside transmitter.

The kerbside transmitter may be a radiofrequency transmitter.

The kerbside transmitter may be an RFID, Wi-Fi™ or Bluetooth™ transmitter.

The location information may be updated based on data received from a central system.

The advantage of this feature is that a driver updated on the availability of parking area, for example if new parking areas are created, or if existing parking areas are booked or reserved by another user.

The location information may include permission information indicating whether the vehicle has permission to use the parking area.

The permission information may indicate a time slot at which the vehicle has permission to use the parking area.

The time slot may be pre-booked.

The method may further comprise the step of authorising or instructing a payment for permission to park in the parking area.

According to a fourth aspect of the invention, there is provided a system for implementing an exception to a parking restriction, the exception being a parking area defined by one or more coordinates, the system comprising:

position receiving means for receiving vehicle position information indicating the position of a vehicle;

a display for indicating the location of the parking area and the position of the vehicle, for guiding the vehicle into the parking area;

monitoring means for monitoring an area including the parking area;

detection means for detecting a vehicle in the monitored area;

position determination means for determining whether a detected vehicle is positioned within the parking area; and permission determination means for determining whether the detected vehicle has permission to park in the parking area.

In one embodiment, the parking area is not marked on the road.

According to a fifth aspect of the invention, there is provided an apparatus for implementing an exception to a parking restriction, the exception being a parking area defined by one or more coordinates, the apparatus comprising:

monitoring means for monitoring an area including the parking area;

detection means for detecting a vehicle in the monitored area;

position determination means for determining whether a detected vehicle is positioned within the parking area; and permission determination means for determining whether the detected vehicle has permission to park in the parking area;

wherein the parking area is not marked on the road.

The apparatus may further comprise charging means for charging an operator or user of the vehicle for permission to park in the parking area.

The apparatus may further comprise means for issuing a fine or penalty in respect of the vehicle if it is determined that the vehicle does not have permission to park in the parking area.

The apparatus may further comprise means for annulling a fine or penalty issued in respect of the vehicle if the vehicle is determined to have permission to park in the parking area.

The exception to the parking restriction may apply at a predetermined time or times, and/or to predetermined vehicles and/or users, and/or to predetermined classes of users and/or vehicles.

The means for monitoring the area may comprise a camera.

The position determining means may comprise:

a display for displaying a representation of the parking area superposed on an image captured by the camera.

The permission determining means may comprise:

identification means for determining an identification number of the vehicle from image data captured by the camera;

checking means for checking the identification number against identification numbers stored in a permission table.

The identification means may include automated number plate recognition, by means of which a computer automatically identifies and extracts a registration number from an image.

The position determining means and/or the permission determining means may comprise:

data receiving means for receiving data transmitted by the vehicle and/or a device located proximal the vehicle.

The data receiving means may be a GPRS receiver.

The data receiving means may be adapted to receive data including at least one of the following:

position information indicating the position of the vehicle and/or the device;

parking area usage information including a time at which the vehicle is parked in the parking area and/or a time at which the vehicle enters and/or exits the parking area; and/or identification information identifying the vehicle.

The position information may be data received from a global navigation satellite system.

The data may include position information indicating the position of the vehicle, the apparatus further comprising:

correcting means, adapted to correct the position information based on a comparison between the received position information and a predefined road layout; and transmitting means for transmitting the corrected position information to the vehicle.

The data may include data read by the vehicle from a kerbside transmitter.

The kerbside transmitter may be a radiofrequency transmitter.

The kerbside transmitter is an RFID, Wi-Fi™ or Bluetooth™ transmitter.

The apparatus may further comprise:

request receiving means for receiving a request for permission to park a vehicle in said parking area;

querying means for querying whether the parking area is available; and updating means for entering identification information of said vehicle in a permission table if the parking area is available.

The apparatus may further comprise transmitting means for transmitting location information indicating the location of the parking area.

The location information may include permission information indicating whether the vehicle has permission to use the parking area.

The permission information may indicate a time or times at which the vehicle has permission to use the parking area.

The parking area may be pre-booked for the vehicle.

According to a sixth aspect of the invention, there is provided an apparatus for indicating an exception to a parking restriction, the exception being a parking area defined by one or more coordinates, the apparatus comprising:

receiving means for receiving location information relating to the location of the parking area;

position receiving means for receiving vehicle position information indicating the current position of a vehicle; and a display for indicating the location of the parking area and the vehicle position;

wherein the parking area is not marked on the road.

The position receiving means may be a receiver adapted to receive position information from a global navigation satellite system.

The apparatus may further comprise a transmitter for transmitting the vehicle position information to a central system; wherein the receiving means is adapted to receive corrected vehicle position information from the central system, based on a comparison between the transmitted vehicle position information and a stored road layout; and the vehicle position is indicated on the display based on the corrected vehicle position information.

The transmitter may be a GPRS transmitter.

The apparatus may further comprise alerting means for alerting a driver of the vehicle when the vehicle is positioned within the parking area.

The apparatus may further comprise a receiver for receiving a signal from a kerbside transmitter when the vehicle is within or proximal to the parking area.

The apparatus may further comprise means for determining whether the vehicle is positioned within the parking area, based on the signal received from the kerbside transmitter.

The receiver may be a radio-frequency receiver.

The receiver may be a radio-frequency identification (RFID) reader.

The receiver may be a Wi-Fi™ or Bluetooth™ receiver.

The location information may be updated based on data received from a central system.

The location information may include permission information indicating whether the vehicle has permission to use the parking area.

The permission information may indicate a time slot at which the vehicle has permission to use the parking area.

The time slot may be pre-booked.

The apparatus may further comprise payment means for authorising or instructing a payment for permission to park in the parking area.

The apparatus may comprise a mobile phone, smart phone or mobile internet device.

A preferred embodiment of the present invention will now be described, by way of example only and not in any limitative sense, with reference to the accompanying drawing, in which.

An exception to a parking restriction may be a loading bay, at which certain vehicles are permitted to stop for short periods of time, generally for the purpose of loading or unloading goods. Loading bays are typically only of sufficient length to allow one vehicle to stop at a time. According to one embodiment of the present invention, a loading bay may be defined by its coordinates, without being marked on the road. This discourages other road users from stopping at the loading bay, as they are unaware of its existence. We will refer to such loading bays as "virtual loading bays". The location of a virtual loading bay must be well-defined for safety reasons, as for a conventional, marked loading bay. The system of the present invention provides a means for implementing a virtual loading bay, by providing a means for guiding permitted users into the virtual loading bay, and providing a means for enforcing the parking restriction taking into account the virtual loading bay exception. However, the present invention may also be applied to conventional, marked loading bays, or other exceptions to parking restrictions, including those which are conventionally indicated by means of signs or markings on the road or kerbside. In particular, the present invention may also be applied to parking restriction exceptions applicable to a specific class of users, for example disabled users (Blue Badge holders). For example, the present invention may be used to help Blue Badge holders to identify their nearest Disabled Parking Bay or other areas where they can legally park, and to guide them to these bays and areas.

Figure 1:
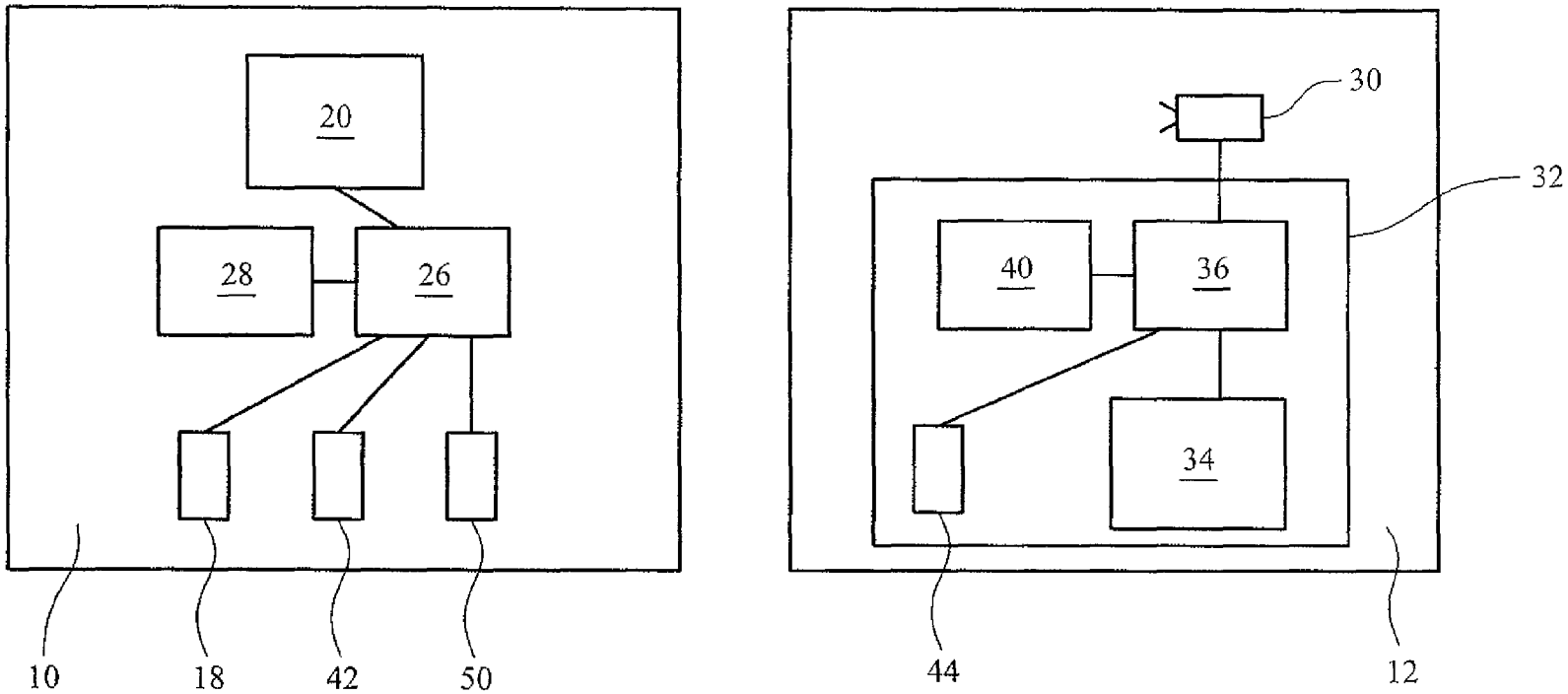
FIG. 1 illustrates a system for implementing a loading bay according to an embodiment of the present invention.

With reference to FIG. 1, a system for implementing an exception to a parking restriction according to an embodiment of the present invention includes a vehicle guiding apparatus 10, for indicating an exception to a parking restriction, and an enforcement apparatus 12, for enforcing an exception to a parking restriction.

Figure 2:
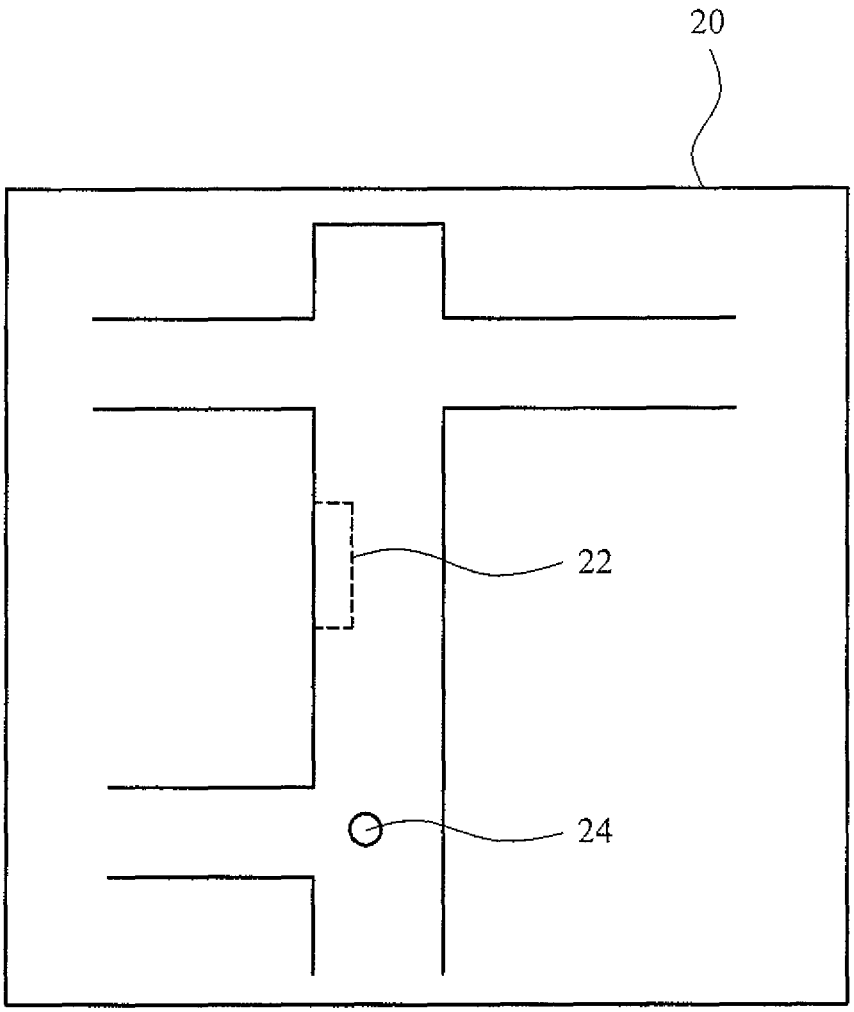
FIG. 2 illustrates a display shown to a user of the system shown in FIG. 1.

The vehicle guiding apparatus 10 includes a position receiving means, in the form of a global navigation satellite system (GNSS) receiver 18. The GNSS receiver 18 calculates its position based on signals received from satellites in the GNSS. A display screen 20 inside the vehicle displays the position of the vehicle, as determined by the GNSS receiver 18, together with locations of parking areas, such as loading bays, which are excluded or excepted from the parking restriction. The loading bay locations are identified to the guiding apparatus 10 by their coordinates, e.g. a GNSS location. Referring to FIG. 2, the display 20 shows a loading bay location 22 and the vehicle position 24 on a map of the area surrounding the vehicle, thereby guiding a driver of the vehicle into the loading bay. In contrast, the view of the roadside does not include any indication of the presence of a loading bay. The vehicle guiding apparatus 10 may alert the driver of the vehicle when the vehicle is positioned within the loading bay, for example by means of an indicator lamp or sound, or by means of a message or symbol displayed on the display screen 20. The guiding apparatus 10 also includes a processor 26 and a storage device 28 for storing location information. As an example, the guiding apparatus 10, or at least the display 20 of the guiding apparatus 10, may be implemented as a mobile phone, such as a smart phone, or a mobile internet device. Application software for implementing the functions of the guiding apparatus 10 may be downloaded to the device, for example in the form of an APP.

Figure 3A:
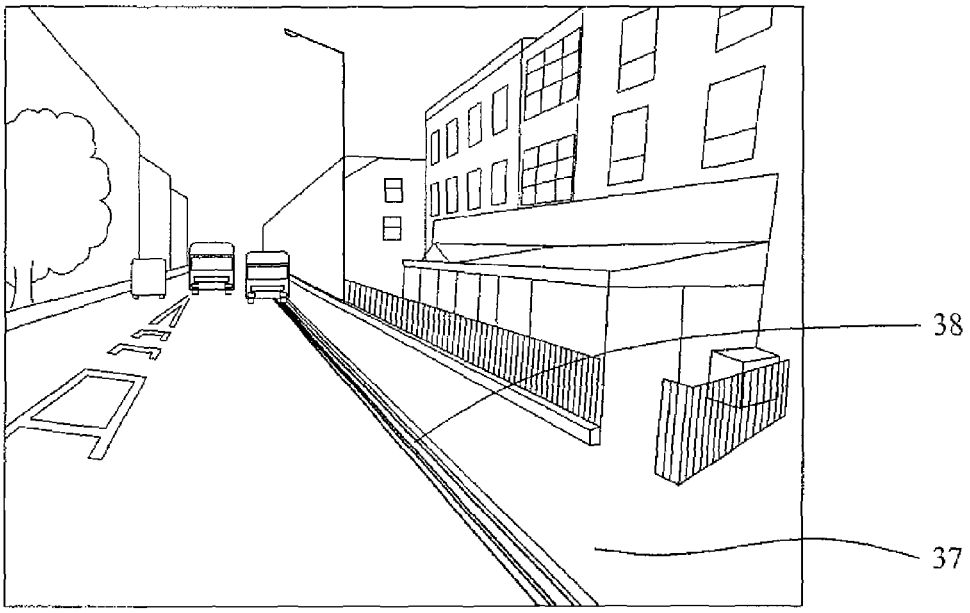
FIG. 3*a* illustrates a view seen by a camera of the system shown in FIG. 1.
Figure 3B:
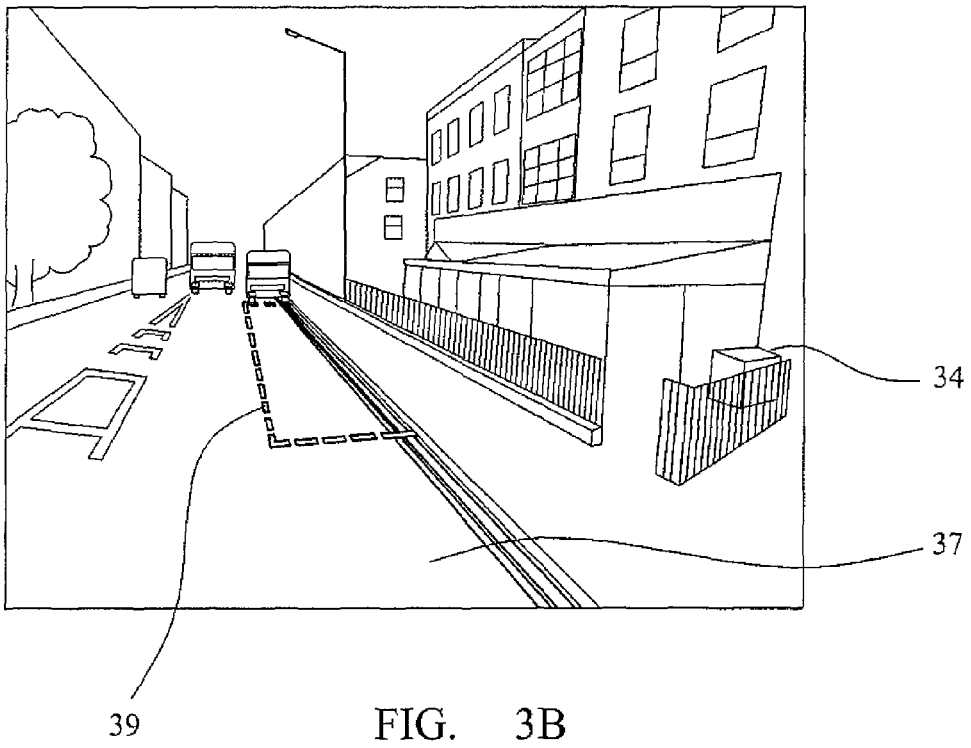
FIG. 3*b* illustrates a display shown to an operator of the system illustrated in FIG. 1.

The enforcement apparatus 12 includes monitoring means, in the form of a CCTV camera 30 for monitoring an area in which a parking restriction applies. Image data captured by the camera 30 is transmitted to a central system 32. The image data is displayed on a screen 34 for viewing by parking enforcement personnel to detect vehicles stopping or parking in the monitored area. Alternatively, or additionally, the image data may be analysed by a computer 36, in order to automatically detect vehicles entering the area in which the parking restriction is effective. Next, it is determined whether a vehicle detected in the monitored area is located within the loading bay. FIG. 3*a* shows the image 37 captured by the camera 30. The image 37 shows a road on which a parking restriction is indicted by means of double lines 38. There is no marking on the road to indicate the presence of a loading bay or any other exception to the parking restriction. The image displayed on display screen 34 is shown in FIG. 3*b*. The display screen 34 shows the location or boundaries 39 of the loading bay be superposed on the image 37 received from the camera 30, such that a person viewing the image can immediately determine whether the detected vehicle is positioned within the parking area. Alternatively, if the image is analysed by computer 36, the position of the loading bay relative to the field of view of the camera 30 is known, such that the relative position of the detected vehicle with respect to the loading bay can be determined.

If the detected vehicle is determined to be stopped or parked within the loading bay, it is further determined whether the detected vehicle has permission to use the loading bay. This may be achieved by identifying the vehicle using manual or automated number plate recognition, and comparing the registration number of the vehicle with stored permissions information. The permissions information may be stored digitally in a storage device 40 of the central system 32 as a table listing the registration numbers of vehicles and the loading bays which each vehicle is allowed to use.

In another embodiment (not shown), the camera may be located in a mobile parking enforcement unit, with an on-board display and/or digital image analysis equipment. The mobile parking enforcement unit may store permissions information, or may communication with a central system to determine whether a vehicle has permission to use the loading bay. Alternatively, the camera image data may be transmitted to a central system for image analysis.

In yet another embodiment (not shown), the parking restriction is enforced by a parking enforcement agent who monitors the area in person. The parking enforcement agent carries a hand-held device including a global navigation satellite system (GNSS) receiver. When the parking enforcement agent finds a vehicle stopped within the area of the parking restriction, he enters the registration number of the vehicle into the hand-held device. The GNSS receiver in the hand-held device calculates its position based on signals received from satellites in the GNSS, the calculated position corresponding to the position of the vehicle provided that the parking enforcement agent is adjacent to the vehicle. The hand-held device also includes a GPRS (general packet radio service) transmitter for transmitting the position of the hand-held device and the registration number of the vehicle to a central system. The central system compares the position of the vehicle to the location of pre-defined loading bays to determine whether the vehicle is positioned within a pre-defined loading bay, before determining whether the vehicle has permission to use the loading bay as described above.

The enforcement apparatus 12 also comprises means for issuing a fine, or penalty charge notice, in respect of vehicles detected using the parking bay without permission, or parking outside the parking bay. Alternatively, the enforcement apparatus 12 may comprise means for annulling fines or penalty charge notices issued to vehicles detected stopping or parking in the monitored area, which are determined to have been parked within the loading bay and with permission. In addition, the enforcement apparatus 12 may comprise means for charging a service charge in respect of exempted vehicles using the parking bay with permission.

The guiding apparatus 10 and the enforcement apparatus 12 each include a GPRS transmitter-receiver 42, 44 for transmitting data between the vehicle and the central system 32. Each vehicle using the scheme transmits position information obtained by its GNSS receiver 18 to the central system 32 using GPRS. In addition to position information, each vehicle also transmits identification information and timing information, so that each vehicle can be tracked by the central system. In particular, each vehicle may transmit loading bay usage information to the central system, including times of entering and exiting a loading bay. This data may be used to ensure that stop times and locations are accurately recorded, thereby improving the accuracy of the enforcement apparatus, or providing an additional record of loading bay usage.

In one embodiment, the enforcement apparatus 12 compares the position information received from each vehicle with a stored road layout map. Preferably, each vehicle transmits position information to the enforcement apparatus at regular intervals, for example each second, so that the enforcement apparatus can then track each vehicle around the road network. By comparing the position information received from the vehicles with the known positions of the roads, the enforcement apparatus can correct the position information calculated by each vehicle's GNSS receiver to correct for multipath errors or 'canyoning' which can affect GNSS performance in built-up areas. The corrected position information can be transmitted back to the respective vehicle for display. Importantly, this improves the accuracy of the position information displayed to the driver, since, in order to accurately guide a vehicle into a loading bay which is not marked on the road, it is necessary to determine the position of the vehicle with an accuracy of the order of one meter.

In order to further improve the accuracy of the system, or as an alternative to the use of a GNSS receiver, the guiding apparatus may include an RFID tag reader 50, which can detect and read RFID tags installed at the locations of the loading bays. This can help to guide a driver to the correct location of the loading bay and to confirm when a vehicle is correctly positioned in a loading bay. Information stored in the RFID tags may be read by the RFID reader 50 and transmitted to the enforcement apparatus 12 together with vehicle identification information and timing information. An RFID tag may be concealed by the roadside, so that an ordinary motorist is not alerted to the presence of a loading bay. Alternatively, Wi-Fi™ or Bluetooth™ or other wireless technology may be used to transmit information between a kerbside device and the guiding apparatus in a vehicle, in order to guide the driver of the vehicle to the correct location of the loading bay and to confirm when a vehicle is correctly positioned in a loading bay.

The present invention allows virtual loading bays to be defined in a flexible manner, to operate for limited periods. For example, a virtual loading bay may be created for the duration of a special event, or may exist only between specific hours, for example to avoid busy times of day. The locations of the loading bays may be stored in advance in the storage unit 28 of the guiding apparatus 10, or may be updated regularly from the central system 32 via GPRS. The guiding apparatus 10 may display only the loading bays which the vehicle is permitted to use. When displaying the loading bays, the guiding apparatus 10 may also display the time slots which have been booked for use by the vehicle, or which have been booked for use by other vehicles.

Permission to use a given loading bay may be granted to specific vehicles only, or may be allocated by a booking system. In the latter case, users of the scheme can book a given loading bay for a specific time slot in advance. The enforcement apparatus 12 will update the permissions information accordingly. A service charge may be levied by the system for permission to use the loading bays. Various charging schemes could be implemented. For example, a charge may be levied each time a loading bay is booked.

The operation of the system will now be described. As a vehicle approaches the location of a loading bay, the driver will be able to view a map of the area on a display screen 20 of a satellite navigation system. The display 20 will indicate the position 24 of the vehicle, the indicated position being updated as the GNSS receiver 18 continuously calculates updated positions of the vehicle. The display 20 will also show the location 22 of the loading bay, based on location information which may be stored in a guiding apparatus 10 in the vehicle, and/or may be updated regularly by receiving data transmitted from the central system 32. By comparing the relative positions of the vehicle and the loading bay, the driver is guided to the loading bay. If the loading bay is not marked on the road or kerbside, the driver will need to rely on the guiding apparatus 10 to be guided to the correct location of the loading bay, in order that he stops in a safe location and does not incur a parking fine.

When the guiding apparatus 10 determines that vehicle is correctly positioned within the loading bay, the driver is alerted. For example, a message may appear on the display screen, or a sound or light signal may be produced.

If an RFID tag is installed at the loading bay, the RFID tag reader 50 of the vehicle will detect and read the RFID tag once the tag is within range. Again, the driver may be alerted when the tag is detected, so that he is guided to the correct location.

The guiding apparatus 10 repeatedly transmits the position of the vehicle, as determined by the GNSS receiver 18, to the central system 32. When the guiding apparatus 10 determines that the vehicle is positioned within the virtual loading bay, it will transmit the time of entry into the loading bay to the central system 32, along with an identification number of the vehicle and its position, and, if applicable, data read from the RFID tag. When the vehicle leaves the loading bay, the time of exit from the loading bay will be transmitted to the central system 32.

The central system 32 will receive and store the information transmitted by the vehicle, and will check whether the vehicle has permission to use the loading bay.

Meanwhile, the enforcement apparatus 12 monitors the area of restricted parking in which the virtual loading bay is located. When a vehicle enters the monitored area, it is recorded by the camera 30. The image data collected by the camera 30, transmitted to the central system 32, and displayed on screen 34, to detect and identify the vehicle and to determine whether the vehicle is located within the virtual loading bay. The display 34 shows the location of the loading bay by means of a graphic overlay 39 on the camera image, as shown in FIG. 3. The registration number of the vehicle may be read from the displayed image, or may be extracted automatically by computer analysis of the image data and compared with permissions information stored in the storage device 37 to determine whether the vehicle has permission to use the loading bay. This information is cross-checked with the information transmitted to the central system 32 from the vehicle.

The enforcement apparatus 12 then issues a fine or penalty charge notice if the vehicle is not permitted to park in the virtual loading bay, or is parked outside of the virtual loading bay. Alternatively, parking fines or penalty charge notices issued by other enforcement means may be checked against the permissions information held by the central system, and be annulled if issued in respect of a vehicle using a virtual loading bay with permission. Also, the enforcement apparatus 12 may issue a service charge when the loading bay is legitimately used by a permitted vehicle.

In addition to, or instead of, the enforcement procedure described above, the area covered by the parking restriction may be monitored in person by a parking enforcement officer. The parking enforcement officer carries a hand-held device equipped with a GNSS receiver and a GPRS transmitter. On spotting a vehicle parked in the area of the parking restriction, the parking enforcement officer enters the registration number of the vehicle into the device. The GNSS receiver determines the position of the device, and thus of the vehicle, and transmits the registration number and position to the central system. The central system will issue a penalty charge notice to the vehicle unless it determines that the vehicle location corresponds to the location of a virtual loading bay and that the vehicle has permission to use it.

It will be appreciated by persons skilled in the art that the above embodiments have been described by way of example only, and not in any limitative sense, and that various alterations and modifications are possible without departure from the scope of the invention as defined by the appended claims.

For example, instead of using a GNSS receiver to determine the position of a vehicle, the guiding apparatus may include a radio-frequency receiver (e.g. an RFID reader) as described above, capable of reading kerbside radio-frequency transmitters (e.g. RFID tags), in order to determine the location of the vehicle when the vehicle is adjacent or close to a loading bay. In this case, the driver of a vehicle would need to know the approximate location of the loading bay in advance, but would be able to find the exact location within the street by means of a signal produced by the guiding apparatus once the vehicle was in the close vicinity of the radio-frequency transmitter. In this case, the guiding apparatus would not necessarily require a display.

As a further alternative, the functions of the transmitter and receiver (or RFID tag and reader) could be interchanged.

As a further alternative, Wi-Fi™ or Bluetooth™ or other wireless technology may be used to transmit information between a kerbside device and the guiding apparatus in a vehicle, in order to guide the driver of the vehicle to the correct location of the loading bay and to confirm when a vehicle is correctly positioned in a loading bay.

The invention claimed is:

1. A method for implementing an exception to a parking restriction, the method comprising the steps of:

defining, by a central data processing system, a parking/loading area by one or more coordinates, the parking/loading area being an exception to a parking restriction on a road, wherein the parking/loading area is not marked on the road, whereby signs and/or markings on the road indicating the parking restriction indicate that the parking restriction applies to the parking/loading area;

transmitting, by said central data processing system to a vehicle, location information indicating the location of the parking/loading area;

monitoring an area of the road including the parking/loading area;

detecting a vehicle parked in the monitored area;

receiving, at said central data processing system by means of a wireless signal, vehicle position information indicating the current position of the vehicle;

determining, by said central data processing system, by means of said position information, whether the detected vehicle is positioned within the parking/loading area; and determining, by said central data processing system, whether the vehicle has permission to park in the parking/loading area.

2. The method according to claim 1, further comprising the step of charging an operator or user of the vehicle for permission to park in the parking/loading area.

3. The method according to claim 1, further comprising the step of issuing a fine or penalty in respect of the vehicle if it is determined that the vehicle does not have permission to park in the parking/loading area.

4. The method according to claim 1, wherein a fine or penalty issued in respect of the vehicle is annulled if the vehicle is determined to have permission to park in the parking/loading area.

5. The method according to claim 1, wherein the exception to the parking restriction applies at a predetermined time or times, and/or to predetermined vehicles and/or users, and/or to predetermined classes of users and/or vehicles.

6. The method according to claim 1, wherein the step of monitoring the area is performed using a camera.

7. The method according to claim 6, wherein the step of determining whether said vehicle has permission to park in the parking/loading area at the time of detecting said vehicle comprises:

determining an identification number of the vehicle from image data captured by the camera; and checking the identification number against identification numbers stored in a permission table.

8. The method according to claim 1, wherein the step of determining whether the detected vehicle is positioned within said parking/loading area and/or the step of determining whether the detected vehicle has permission to park in the parking/loading area comprises:

receiving, by said central data processing system, data transmitted by the vehicle and/or a device located proximal the detected vehicle, said data including identification information identifying the detected vehicle; and comparing, by said central data processing system, the identification information with permissions information stored by said data processing system.

9. The method according to claim 8, wherein said data further comprises:

parking/loading area usage information including a time or times at which the vehicle is parked in the parking/loading area and/or at which the vehicle enters and/or exits the parking/loading area.

10. The method according to claim 1, wherein the position information is determined by a global navigation satellite system.

11. The method according to claim 1, further comprising receiving, at said central data processing system, data transmitted by said vehicle, said vehicle having received said data from a kerbside transmitter.

12. The method according to claim 11, wherein the kerbside transmitter is at least one of a radio-frequency transmitter, a radio-frequency identification tag, a Wi-Fi™ or Bluetooth™ transmitter.

13. The method according to claim 1, further comprising the steps of:

receiving a request for permission to park a vehicle in said parking/loading area;

checking whether the parking/loading area is available; and entering identification information of said vehicle in a permission table if the parking/loading area is available.

14. The method according to claim 1, including transmitting, by said central data processing system, permission information indicating whether the vehicle has permission to use the parking/loading area including a time or times at which the vehicle has permission to use the parking/loading area.

15. A method for indicating an exception to a parking restriction, the method comprising the steps of:

receiving, at a vehicle, from a central data processing system, location information relating to the location of a parking/loading area, wherein the parking/loading area is defined by one or more coordinates and is an exception to a parking restriction on a road, wherein the parking/loading area is not marked on the road, wherein signs and/or markings on the road indicating the parking restriction indicate that the parking restriction applies to said parking/loading area;

receiving, at the vehicle by means of a wireless signal, vehicle position information indicating the current position of the vehicle; and indicating the location of the parking/loading area and the vehicle position on a display in said vehicle.

16. An apparatus for implementing an exception to a parking restriction, the apparatus comprising:

a data processing system, operable to define at least one parking/loading area by one or more coordinates, the parking/loading area being an exception to a parking restriction on a road, wherein the parking/loading area is not marked on the road, wherein signs and/or markings on the road indicating the parking restriction indicate that the parking restriction applies to said parking/loading area;

at least one transmitter for transmitting, to a vehicle, location information indicating the location of the parking/loading area;

at least one monitoring device for monitoring an area of the road including the parking/loading area;

at least one detection device for detecting a vehicle parked in the monitored area, wherein said data processing system is configured to receive, by means of a wireless signal, vehicle position information indicating the position of the vehicle;

wherein said data processing system is configured to determine, by means of said position information, whether a detected vehicle is positioned within the parking/loading area, and wherein said data processing system is configured to determine whether the detected vehicle has permission to park in the parking/loading area.

17. The apparatus according to claim 16, wherein said apparatus comprises:

at least one data receiving device for receiving data transmitted by a device located proximal the vehicle.

18. The apparatus according to claim 17, wherein the data receiving device is a GPRS receiver.

19. The apparatus according to claim 16, wherein said position information comprises data read by the vehicle from a kerbside transmitter.

20. The apparatus according to claim 19, wherein the kerbside transmitter is a radio-frequency transmitter, an RFID, Wi-Fi™ or Bluetooth™ transmitter.

21. The method according to claim 1, wherein the position information is received by said central data processing system from said vehicle and/or from a device located proximal said vehicle.

22. The method according to claim 15, further comprising the steps of:

receiving a signal from a kerbside transmitter when the vehicle is within or proximal to the parking/loading area; and alerting a driver of the vehicle when the vehicle is positioned within the parking/loading area, based on said signal.

* * * * *